US012364349B1

(12) United States Patent
Miles

(10) Patent No.: US 12,364,349 B1
(45) Date of Patent: Jul. 22, 2025

(54) OBJECT HANGING AID SYSTEMS, DEVICES AND METHODS

(71) Applicant: Clemmon Miles, Texarkana, AR (US)

(72) Inventor: Clemmon Miles, Texarkana, AR (US)

( * ) Notice: Subject to any disclaimer, the term of this patent is extended or adjusted under 35 U.S.C. 154(b) by 0 days.

(21) Appl. No.: 18/930,444

(22) Filed: Oct. 29, 2024

(51) Int. Cl.
*A47G 1/20* (2006.01)

(52) U.S. Cl.
CPC ..... *A47G 1/20* (2013.01)

(58) Field of Classification Search
CPC ..... A47G 1/20; A47G 1/205; B44C 5/02
USPC ..... 248/493, 544, 497
See application file for complete search history.

(56) References Cited

U.S. PATENT DOCUMENTS 1,675,282 A * 6/1928 Strand ..... A47G 1/168 248/494
1,675,771 A * 7/1928 Sterling ..... A47G 1/168 248/494
3,251,569 A * 5/1966 Rynearson ..... A47G 1/1613 248/495
3,384,987 A * 5/1968 Prechtl ..... A47G 1/168 16/86 A
4,566,665 A * 1/1986 Rynearson ..... A47G 1/202 248/495
5,803,425 A * 9/1998 McCoy, II ..... A47G 1/1633 248/909
6,311,407 B1 * 11/2001 Muraishi ..... G01C 15/10 33/392
8,695,936 B2 * 4/2014 Park ..... A47G 1/1633 248/231.91
2009/0193674 A1 * 8/2009 Megahed ..... A47G 1/205 33/666
2019/0070877 A1 * 3/2019 Flores ..... A47G 1/205

* cited by examiner

*Primary Examiner* — Anita M King
(74) *Attorney, Agent, or Firm* — R. Keith Harrison

(57) ABSTRACT

Object hanging aid systems suitable for assisting a user in hanging an object having an object frame and an object hanging wire on a wall surface of a wall may include at least one object hanging aid device. The object hanging aid device may be configured for placement between the object frame and the object hanging wire of the object to deploy the object hanging wire from a flaccid wire configuration to an extended wire configuration. The object hanging aid device may include a device base and a device cap on the device base. The device base may be configured to engage the object frame. The device cap may be configured to engage the object hanging wire. Object hanging aid devices and methods are also disclosed.

19 Claims, 8 Drawing Sheets

OBJECT HANGING AID SYSTEMS, DEVICES AND METHODS

FIELD

Illustrative embodiments of the disclosure generally relate to the hanging of picture frames, mirrors and other objects on a wall surface. More particularly, illustrative embodiments of the disclosure relate to object hanging aid systems, devices and methods which are suitable to assist a user in hanging a picture, mirror or other object on a wall surface without requiring assistance from other persons.

BACKGROUND

The background description provided herein is solely for the purpose of generally presenting the context of the illustrative embodiments of the disclosure. Aspects of the background description are neither expressly nor impliedly admitted as prior art against the claimed subject matter.

In the hanging of objects such as pictures, mirrors and the like on a wall surface, a hanging wire which is attached to the back of the object is typically engaged with a hook on the wall surface. Attempting to locate the hook on the wall surface behind the object, however, may be difficult. Consequently, many persons may encounter difficulty in hanging large objects on a wall surface, especially without assistance from other persons. Persons who live alone may not be able to hang these objects without hired help.

Accordingly, object hanging aid systems, devices and methods which are suitable to assist a user in hanging a picture, mirror or other object on a wall surface without requiring assistance from other persons are needed.

SUMMARY

Illustrative embodiments of the disclosure are generally directed to object hanging aid systems suitable for assisting a user in hanging an object having an object frame and an object hanging wire on a wall surface of a wall. An illustrative embodiment of the object hanging aid system may include at least one object hanging aid device. The object hanging aid device may be configured for placement between the object frame and the object hanging wire of the object to deploy the object hanging wire from a flaccid wire configuration to an extended wire configuration. The object hanging aid device may include a device base and a device cap on the device base. The device base may be configured to engage the object frame. The device cap may be configured to engage the object hanging wire. Accordingly, in hanging of the object on the wall, the extended wire configuration of the object hanging wire may more easily engage an object hanging hook on the wall surface, thereby enabling the user to hang the object without requiring the assistance of others.

BRIEF DESCRIPTION OF THE DRAWINGS

Illustrative embodiments of the disclosure will now be described, by way of example, with reference to the accompanying drawings, in which.

Like reference numerals refer to like parts throughout the several views of the drawings.

DETAILED DESCRIPTION

Figure 1:
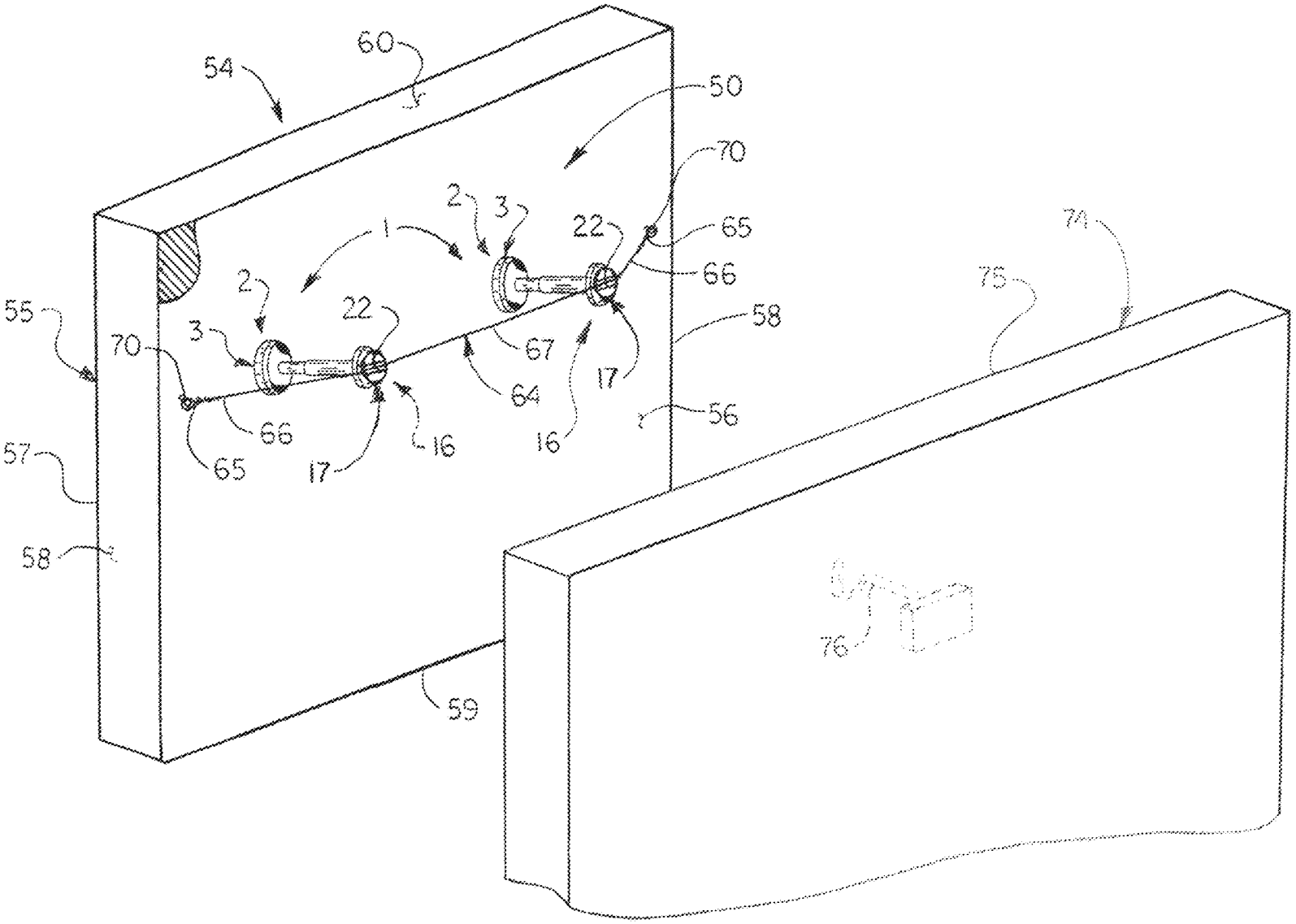
FIG. 1 is a perspective view of an illustrative embodiment of the object hanging aid systems of the disclosure, having a pair of object hanging aid devices deployed in place between an object frame of an object to be hanged and an object hanging wire on the object frame preparatory to hanging of the object on a wall surface of a wall in typical application of the systems.
Figure 6:
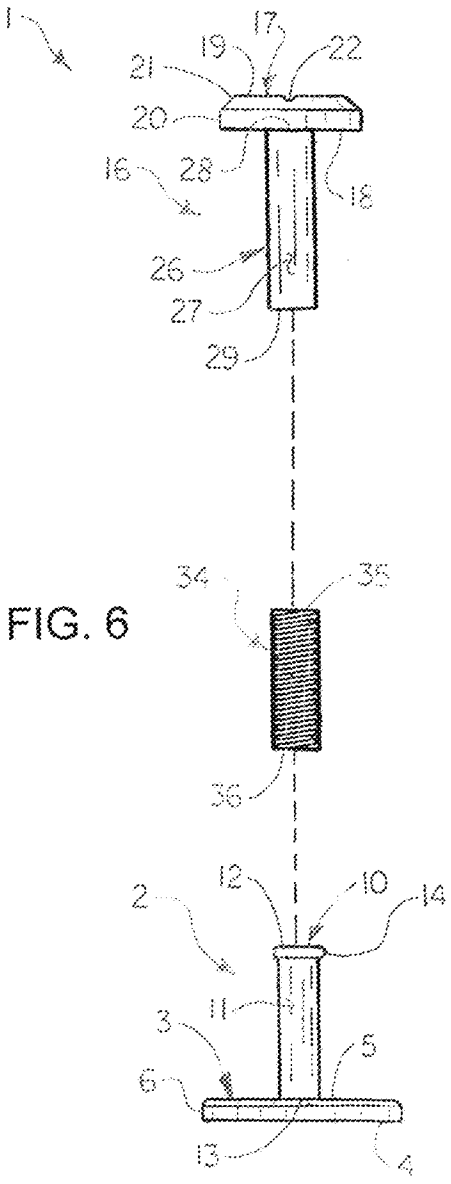
FIG. 6 is an exploded side view of the disassembled object hanging aid device.
Figure 3:
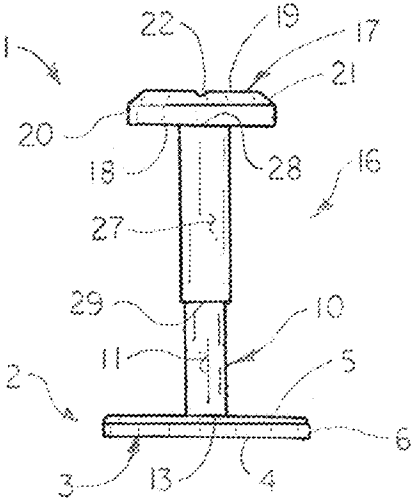
FIG. 3 is a side view of the object hanging aid device illustrated in FIG. 2.
Figure 5:
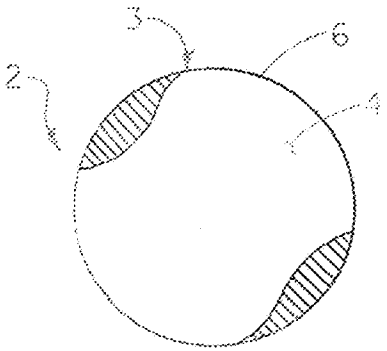
FIG. 5 is a rear view of the object hanging aid device.
Figure 2:
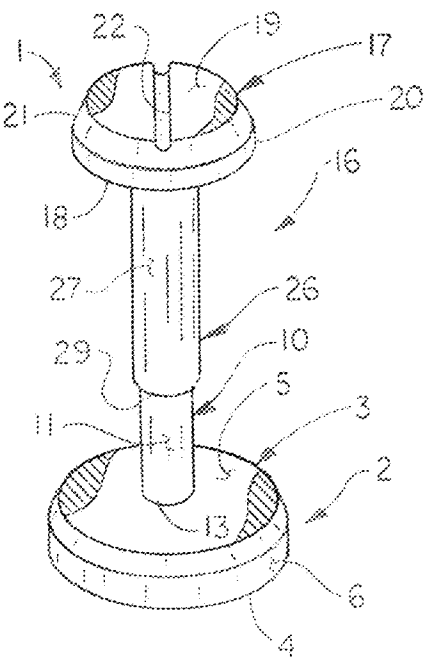
FIG. 2 is a side front perspective view of an illustrative embodiment of an object hanging aid device of the object hanging aid systems.
Figure 4:
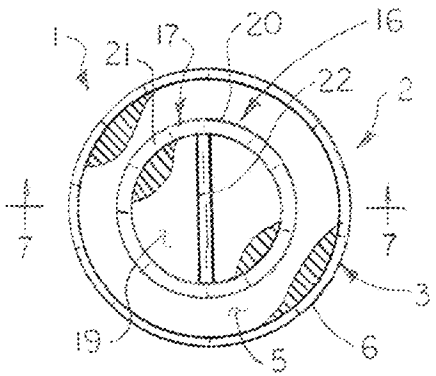
FIG. 4 is a front view of the object hanging aid device.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the subject matter as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

All methods set forth in the present disclosure may be performed in any suitable order of steps unless otherwise indicated herein or contradicted by the rules of logic. The use of any and all examples or exemplary language provided herein is intended to clearly describe the subject matter of the disclosure and is not intended to be limiting on the scope of the subject matter set forth in the claims. No element, step, ingredient, or limitation mentioned or described in the specification shall not be construed as regarding any unclaimed component, step, or limitation to be essential in practicing the claimed subject matter.

Unless expressly or implicitly indicated otherwise, throughout the description and the appended claims, the terms "comprise", "comprising", "comprised of" and the like are to be construed in an inclusive sense as opposed to an exclusive or exhaustive sense, and are equivalent to the phrase, "including but not limited to". Each embodiment disclosed herein can comprise, consist essentially of, or consist of its particular stated element, step, ingredient, or limitation. As used herein, the transition terms "comprise", "comprises", "comprising", "include", "includes", "including", "is", "has", "having" or the like means "includes, but is not limited to, and allows for the inclusion of unspecified elements, steps, ingredients, or limitations, even in major amounts". The transitional phrase "consisting of" excludes any element, step, ingredient, or limitation not specified. The transition phrase "consisting essentially of" shall limit the scope of the embodiment to the specified elements, steps, ingredients, or limitations and to those that do not materially affect the embodiment. Throughout the written description, drawings and claims appended hereto, unless otherwise noted, it shall be recognized and understood that each embodiment of the described, illustrated and claimed subject matter may comprise, consist essentially of, or consist of any component, element or combination of components or elements set forth herein.

Unless otherwise noted using precise or limiting terminology, all numbers which express quantities of ingredients throughout the specification and claims are to be understood as being approximations of the numerical value cited to express the quantities of those ingredients. As used throughout the specification and claims, the term "about" has the meaning reasonably ascribed to it by a person skilled in the art when used in conjunction with a stated numerical value or range, i.e., denoting from the exact stated value or range to somewhat more or somewhat less than the stated value or range, from a deviation of from 0% with respect to the stated value or range to up to and including 20% of the stated value or range in either direction.

Various illustrative embodiments of the disclosure are described herein. Variations on the described illustrative embodiments may become apparent to those of ordinary skill in the art in reading the specification, drawings and claims of the disclosure. Accordingly, the disclosure encompassed by the specification, claims and drawings includes all modifications and equivalents of the subject matter recited in the claims as permitted by applicable law. Additionally, any combination of the elements in all possible variations thereof is encompassed by the subject matter of the disclosure unless otherwise indicated herein.

The term "or combinations thereof as used herein refers to all permutations and combinations of the listed items preceding the term. For example, "A, B, C, or combinations thereof is intended to include at least one of A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

Referring to the drawings, an illustrative embodiment of the object hanging aid systems, hereinafter system, is generally indicated by reference number 50. As illustrated in FIG. 1 and will be hereinafter further described, the system 50 may be suitable for assisting a user (not illustrated) in hanging an object 54 such as a picture or a mirror, for example and without limitation, on a wall surface 75 of a wall 74. The object 54 may have an object frame 55 and an object hanging wire 64 on the object frame 55.

Figure 10:
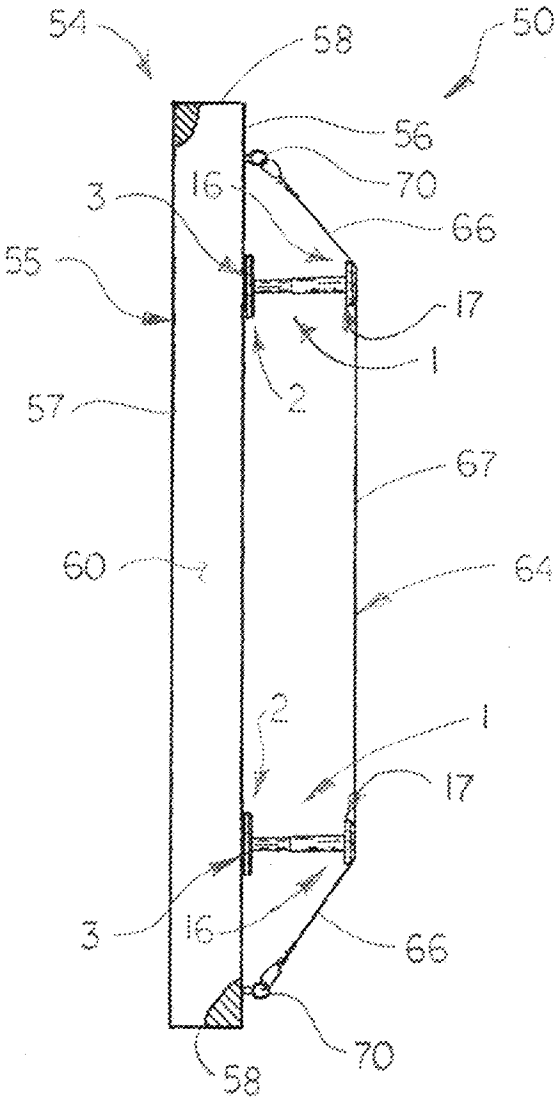
FIG. 10 is a top view of the object hanging aid devices of the illustrative object hanging aid system placed between the object frame and the object hanging wire to deploy the object hanging wire in the extended wire configuration.

The system 50 may include at least one, and typically, a pair of spaced-apart object hanging aid devices 1. The object hanging aid devices 1 may be configured for placement between the object frame 55 and the object hanging wire 64 of the object 54 to deploy the object hanging wire 64 from a flaccid wire configuration (FIG. 9) to an extended wire configuration (FIG. 10). The object hanging aid device 1 may include a device base 2 and a device cap 16 on the device base 2. The device base 2 may be configured to engage the object frame 55 of the object 54. The device cap 16 of the object handing device 1 may be configured to engage the object hanging wire 64. Accordingly, in subsequent hanging of the object 54 on the wall 74, the extended wire configuration of the object hanging wire 64 may facilitate ease in engagement of the object hanging wire 64 with an object hanging hook 76 on the wall surface 75, thereby enabling the user to hang the object 54 without requiring the assistance of other persons.

As illustrated in FIGS. 2-8, the device base 2 of each object hanging aid device 1 may include a base plate 3. The base plate 3 of the device base 2 may include an object engaging surface 4 which may be suitably configured to engage the object frame 55 of the object 54. In some embodiments, the object engaging surface 4 of the base plate 3 may be flat or planar to flatly or evenly engage the typically correspondingly flat or planar profile or contour of the object frame 55. The base plate 3 may include a cap mount surface 5 which extends parallel and spaced-apart to the object engaging surface 4. A side base plate surface 6 may extend from the object engaging surface 4 to the cap mount surface 5. In some embodiments, the side base surface 6 may be cylindrical or circular, as illustrated, or may be oval, elliptical, triangular, square or may have any other polygonal or non-polygonal shape.

Figure 7:
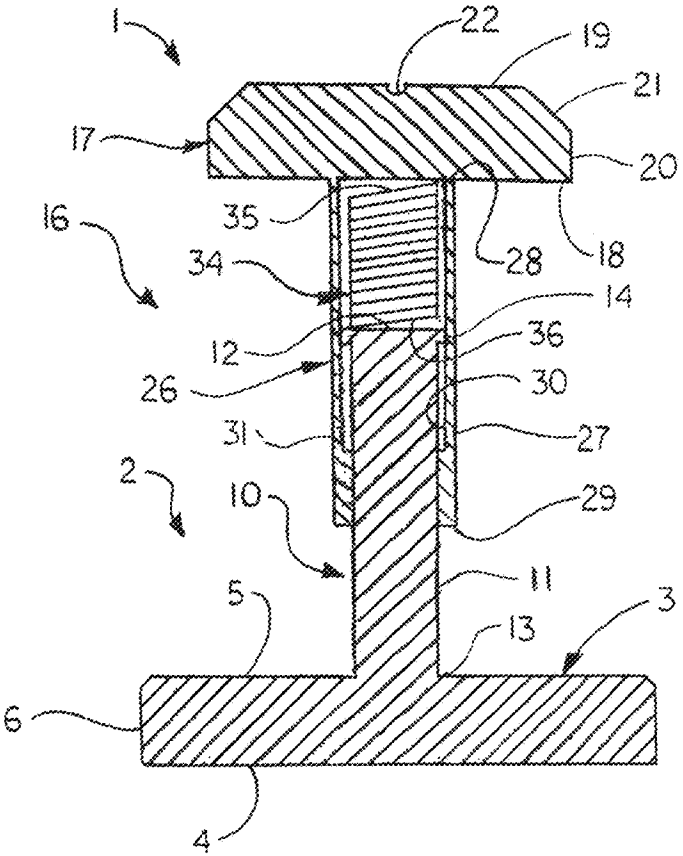
FIG. 7 is a longitudinal sectional view, taken along section lines 7-7 in FIG. 4, of the assembled object hanging aid device.

A base stem 10 may extend from the cap mount surface 5 of the base plate 3. The base stem 10 may have a proximal base stem end 13 at the cap mount surface 5. In some embodiments, the proximal base stem end 13 of the base stem 10 may be attached to the cap mount surface 5 via welding, mechanical fasteners and/or by using other attachment techniques known by those skilled in the art. Alternatively, the base stem 10 may be molded, cast and/or otherwise fabricated in one piece with the base plate 3 at the proximal base stem end 13 typically according to the knowledge of those skilled in the art. A side base stem surface 11 may extend from the proximal base stem end 13 of the base stem 10. As illustrated in FIGS. 7 and 8, a terminal, distal base stem surface 12 may terminate the extending or distal end of the side base stem surface 11. In some embodiments, the base stem 10 may have a cylindrical, circular, oval, elliptical cross-sectional shape or may have a triangular, square or other polygonal or non-polygonal cross-sectional shape. As illustrated in FIGS. 6-8B, in some embodiments, a base stem flange 14 may extend outwardly from the side base stem surface 11 at the distal base stem surface 12 of the base stem 10 typically for purposes which will be hereinafter described.

Figure 14:
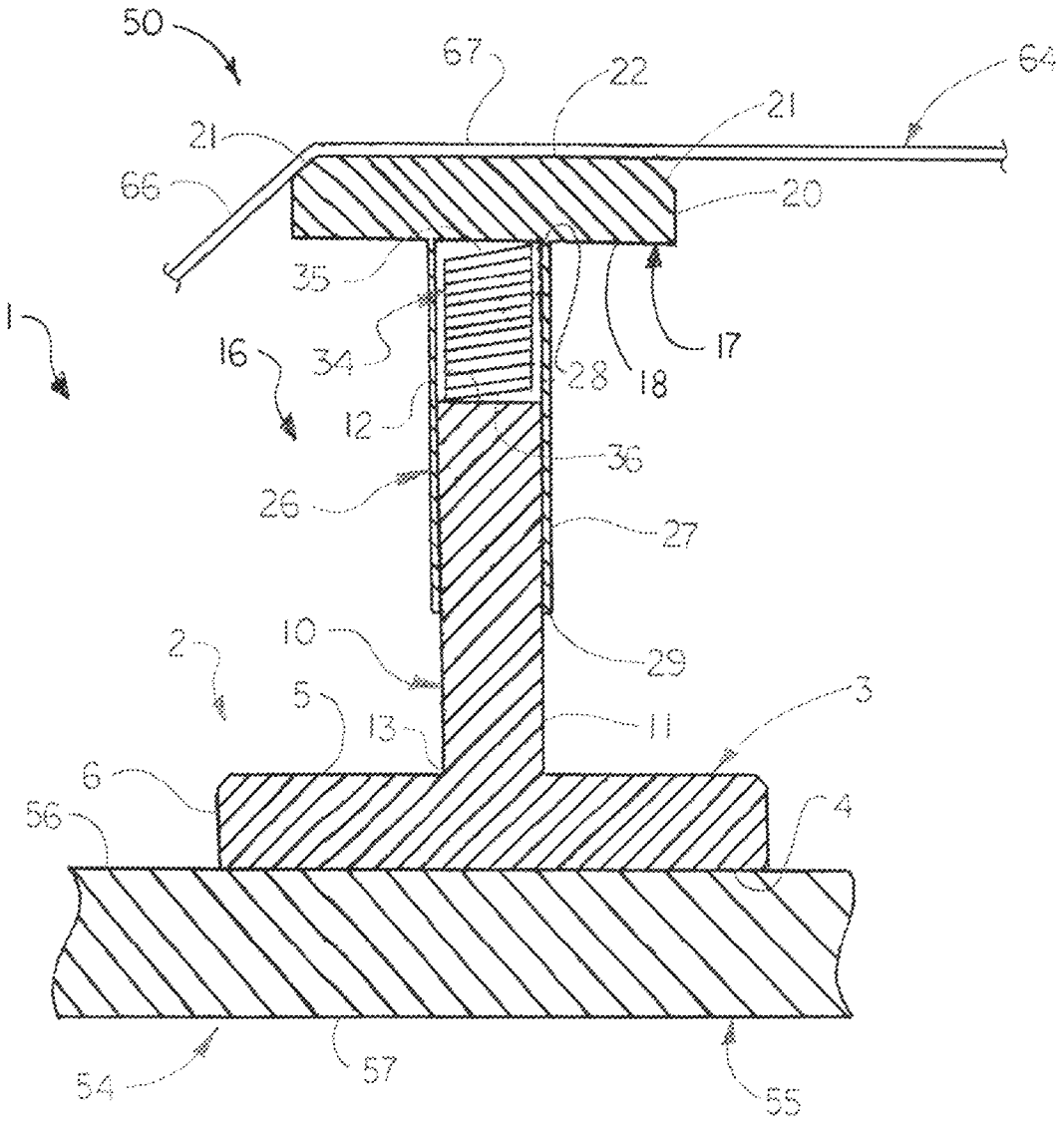
FIG. 14 is a longitudinal sectional view of the object hanging aid device with the device base of the device engaging the object frame of the object and the object hanging wire engaging the device cap of the device in the extended wire configuration.

As further illustrated in FIGS. 2-8, the device cap 16 of each object hanging aid device 1 may include a cap head 17. The cap head 17 may have an inner cap head surface 18. An outer cap head surface 19 may be disposed parallel and spaced-apart to the inner cap head surface 18. A side cap head surface 20 may extend from the inner cap head surface 18 to the outer cap head surface 19. A wire groove 22 may extend into and along the outer cap head surface 19 of the cap head 17. The wire groove 22 may be sized and configured to receive the object hanging wire 64 in hanging of the object 54, as illustrated in FIG. 14 and will be hereinafter described. The wire groove 22 may bisect the outer cap head surface 19 of the cap head 17. In some embodiments, a beveled cap head surface 21 may extend from the outer cap head surface 19 to the side cap head surface 20 of the cap head 17. The side cap head surface 20 and the beveled cap head surface 21 of the cap head 17 may be cylindrical or circular, as illustrated, or may be oval, elliptical, triangular, square or may have any other polygonal or non-polygonal shape.

A cap housing 26 may extend from the cap head 17 of the device cap 16. As illustrated in FIGS. 7 and 8, the cap housing 26 may have a cap interior 30. The cap interior 30 of the cap housing 26 may be suitably sized and configured to slidably receive the base stem 10 of the device base 2. As further illustrated in FIGS. 7 and 8, the cap housing 26 may have a cap housing wall 27. The cap housing wall 27 may have a proximal housing wall end 28 at the inner cap head surface 18 of the cap head 17 and an open distal housing wall end 29 opposite the proximal housing wall end 28. In some embodiments, the proximal housing wall end 28 of the cap housing wall 27 may be attached to the inner cap head surface 18 of the cap head 17 via welding, mechanical fasteners and/or by using other attachment techniques known by those skilled in the art. Alternatively, the cap housing wall 27 may be molded, cast and/or otherwise fabricated in one piece with the cap head 17 at the proximal housing wall end 28 typically according to the knowledge of those skilled in the art. The cap interior 30 may be formed by the cap housing wall 27 and may extend from the proximal housing wall end 28 to the distal housing wall end 29.

As further illustrated in FIGS. 7 and 8, in some embodiments, the device cap 16 may be extendable and retractable with respect to the device base 2 of each object hanging aid device 1. At least one device spring 34 may be disposed between the device base 2 and the device cap 16. For example and without limitation, in some embodiments, the device spring 34 may be disposed in the cap interior 30 of the cap housing 26. The device spring 34 may include at least one coiled spring and may have a cap engaging end 35 and a base engaging end 36. The device spring 34 may have a width or diameter which is less than the width or diameter of the base stem 10 of the device base 2. Accordingly, in insertion of the base stem 10 of the device base 2 into the cap interior 30 of the cap housing 26, the cap engaging end 35 of the device spring 34 may engage the inner cap head surface 18 of the cap head 17, whereas the base engaging end 36 of the device spring 34 may be engaged by the distal base stem surface 12 on the base stem 10 of the device base 2. The device spring 34 may normally bias the device cap 16 away from the device base 2 to counteract the tension of the object hanging wire 64 in placement of each object hanging aid device 1 between the object hanging wire 64 and the object frame 55 of the object 54. In alternative embodiments, the device cap 16 may adjustably engage the device base 2 via a threaded and/or other type of connection to facilitate selective positional deployment of the device cap 16 with respect to the device base 2 depending typically on the tension of the object hanging wire 64 and the distance between the object hanging wire 64 and the rear frame surface 56 of the object frame 55 in the flaccid wire configuration of the object hanging wire 64.

Figure 8A:
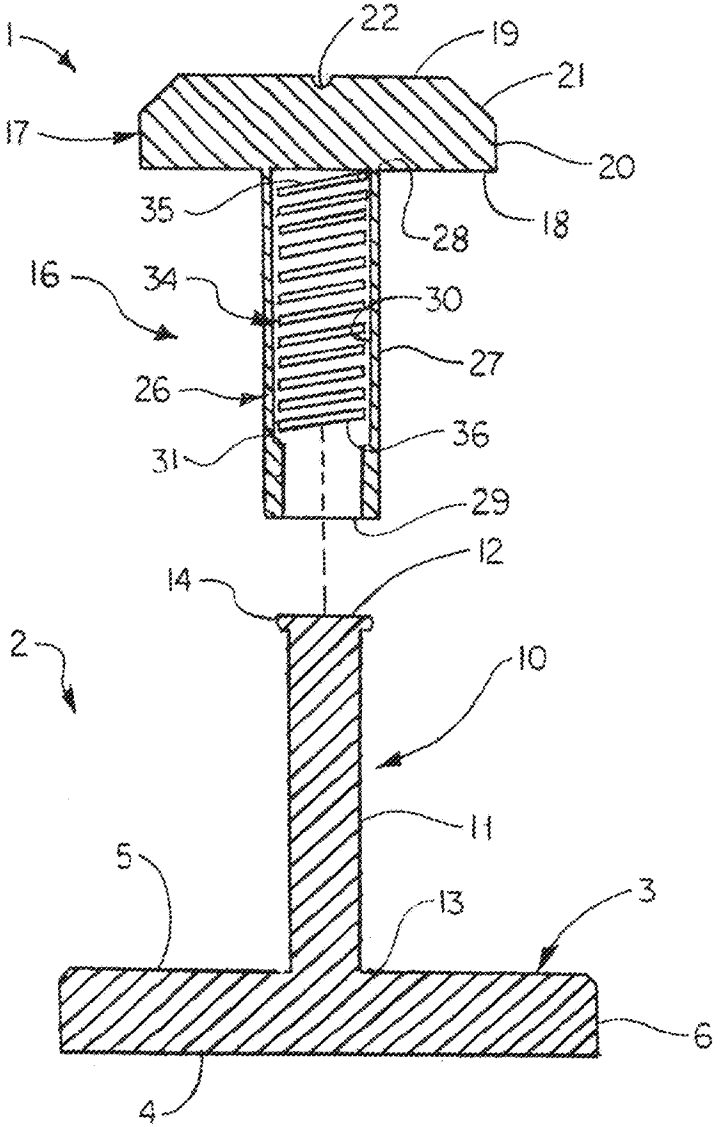
FIG. 8A is an exploded view of the sectioned object hanging aid device illustrated in FIG. 7 in a disassembled state, with the device cap removed from the device base of the device.
Figure 8B:
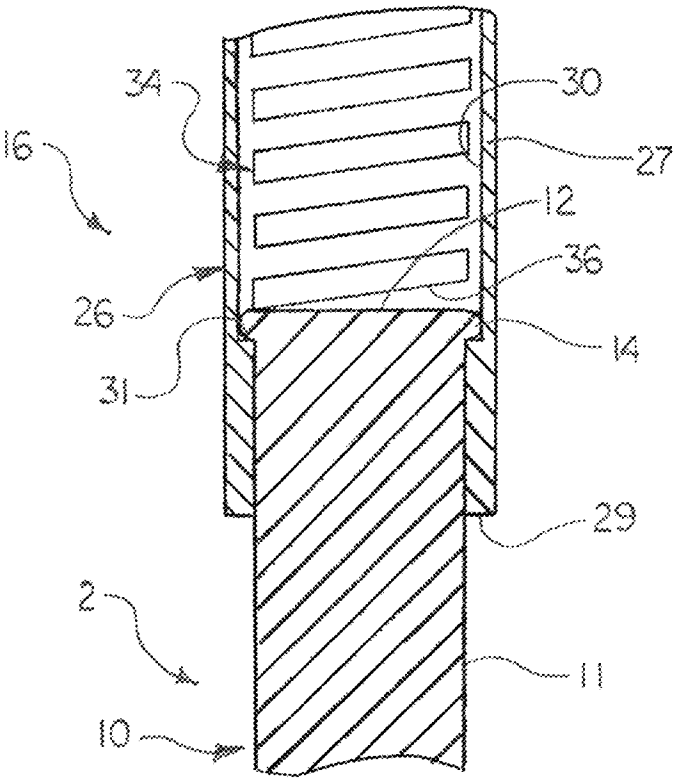
FIG. 8B is an enlarged sectional view illustrating typical engagement of a base stem flange on the base stem of the device base with a cap shoulder in the cap interior of the device cap to prevent removal of the device cap from the device base.

As illustrated in FIGS. 7, 8A and 8B, in some embodiments, a cap shoulder 31 may protrude inwardly from the interior surface of the cap housing wall 27 into the cap interior 30 at the distal housing wall end 29 of the cap housing wall 27. Accordingly, as illustrated in FIG. 8B, in the extended position of the device cap 16 with respect to the device base 2, the cap shoulder 31 may engage the base stem flange 14, against the bias imparted by the device spring 34, to prevent removal of the device cap 16 from the device base 2.

The device base 2, the device cap 16 and/or other components of each object hanging aid device 1 may be fabricated of plastic, wood, metal, fiberglass, composite materials, other hard material or materials, or combinations thereof. Suitable fabrication techniques for the device base 2, the device cap 16 and/or other components of each object hanging aid device 1 may include but are not limited to casting, molding, machining, lathing, 3D printing, sawing, cutting, milling, lathing and combinations thereof.

Figure 9:
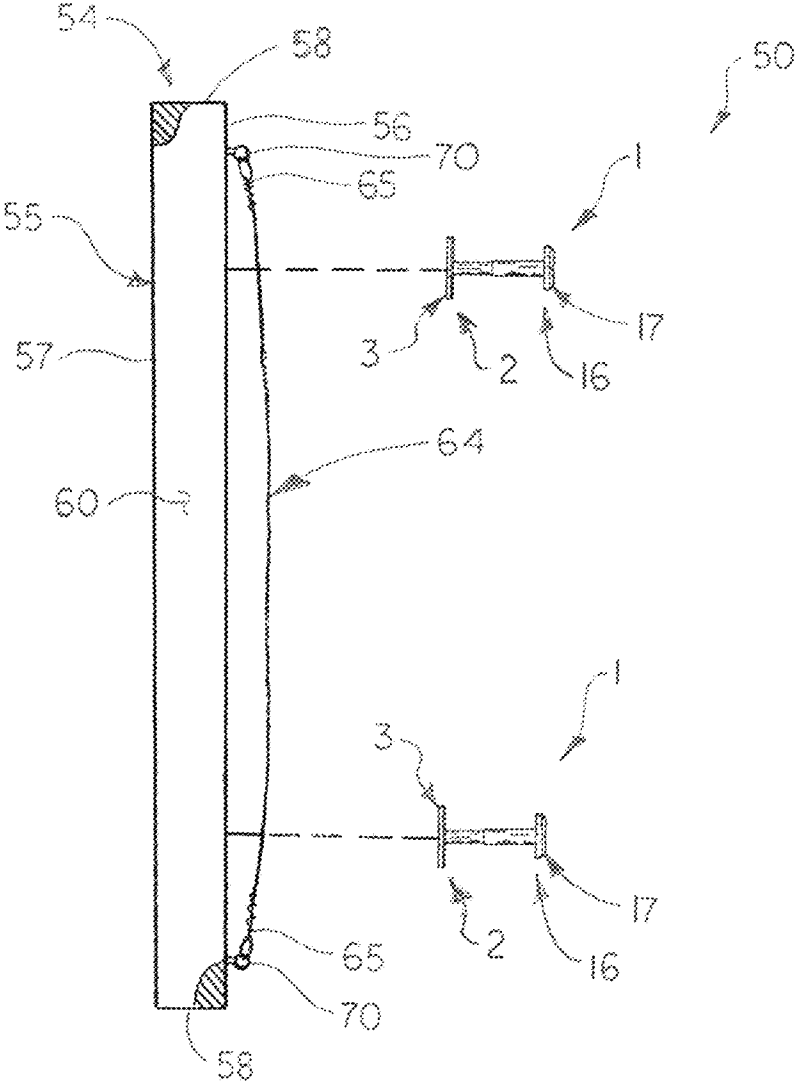
FIG. 9 is an exploded top view illustrating typical placement of a pair of the object hanging aid devices of the illustrative object hanging aid system between the object frame of the object to be hanged and the object hanging wire on the object frame to deploy the hanging wire from a flaccid wire configuration to an extended wire configuration preparatory to hanging the object on the wall surface of the wall in typical application of the object hanging aid systems.

As illustrated in FIGS. 1 and 11-14, in typical application of the system 50, at least one object hanging aid device 1 may be placed between the object frame 55 of the object 54 to be hung and the object hanging wire 64 to deploy the object hanging wire 64 from the flaccid wire configuration illustrated in FIG. 9 to the extended wire configuration illustrated in FIG. 10. Accordingly, the extended wire configuration of the object hanging wire 64 may enable a user to more easily facilitate engagement of the object hanging wire 64 with the object hanging hook 76 on the wall surface 75 in hanging of the object 54 on the wall 74 without the user's requiring the assistance of others for the purpose.

The object 50 to be hung on the wall surface 75 of the wall 74 may be a picture or a mirror, for example and without limitation. Accordingly, in some applications, the object frame 55 of the object 54 may have at least a rear frame surface 56 and a front frame surface 57. The object frame 55 may be square or rectangular with a pair of side frame surfaces 58, a bottom frame surface 59 and a top frame surface 60. Alternatively, the object frame 55 may be circular, oval or elliptical or may have any other polygonal or non-polygonal shape.

The object hanging wire 64 may have opposite wire ends 65. The wire ends 65 of the object hanging wire 64 may be attached to the rear frame surface 56 of the object frame 55 using a pair of wire attachment eye hooks 70, typically in the conventional manner. As illustrated in FIG. 9, the object hanging wire 64 may normally be disposed in a flaccid wire configuration. Accordingly, at least one, and typically, a pair of the object hanging aid devices 1 may initially be placed between the object frame 55 and the object hanging wire 64 to deploy the object hanging wire 64 from the flaccid wire configuration to the extended wire configuration illustrated in FIG. 10. In the extended wire configuration, the object hanging wire 64 may have a pair of side wire segments 66 which extend from the wire attachment eye hooks 70 to the respective object hanging aid devices 1 and a spanning wire segment 67 which extends between the side wire segments 66 and the object hanging aid devices 1.

As illustrated in FIG. 14, each object hanging aid device 1 may be deployed in place by engagement of the object hanging surface 4 on the base plate 3 of the device plate 2 with the rear frame surface 56 of the object frame 55 and engagement of the cap head 17 of the device cap 16 with the object hanging wire 64. In some applications, the wire groove 22 in the outer cap head surface 19 of the cap head 17 may receive the object hanging wire 64. As it transitions from the spanning wire segment 67 to each side wire segment 66, the object hanging wire 64 may engage the beveled cap head surface 21 on the cap head 17 of the corresponding object hanging aid device 1. In some embodiments, the device spring 34 may normally bias the device cap 16 away from the device base 2, as further illustrated in FIG. 14, to counteract the tension of the object hanging wire 64 in the extended wire configuration.

Figure 13:
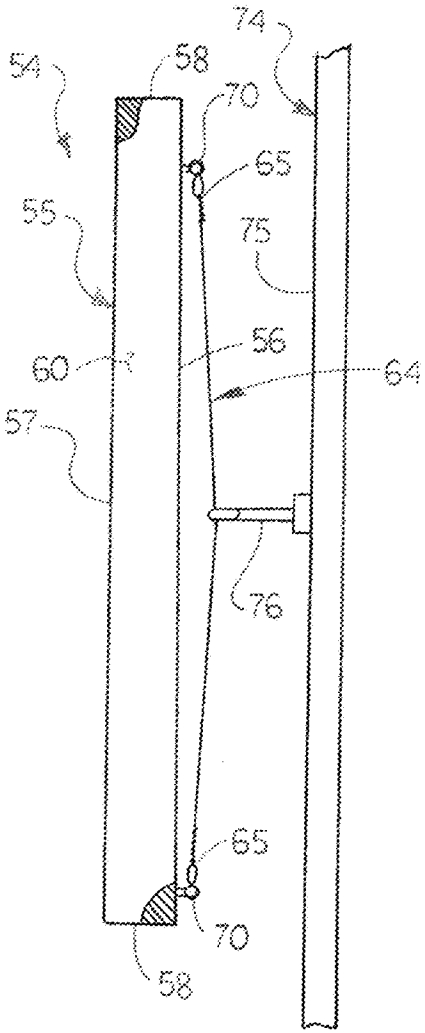
FIG. 13 is a top view of the object hanging wire engaging the object hanging hook on the wall surface in a hanging wire configuration as the object hanging wire supports the object on the wall surface.
Figure 12:
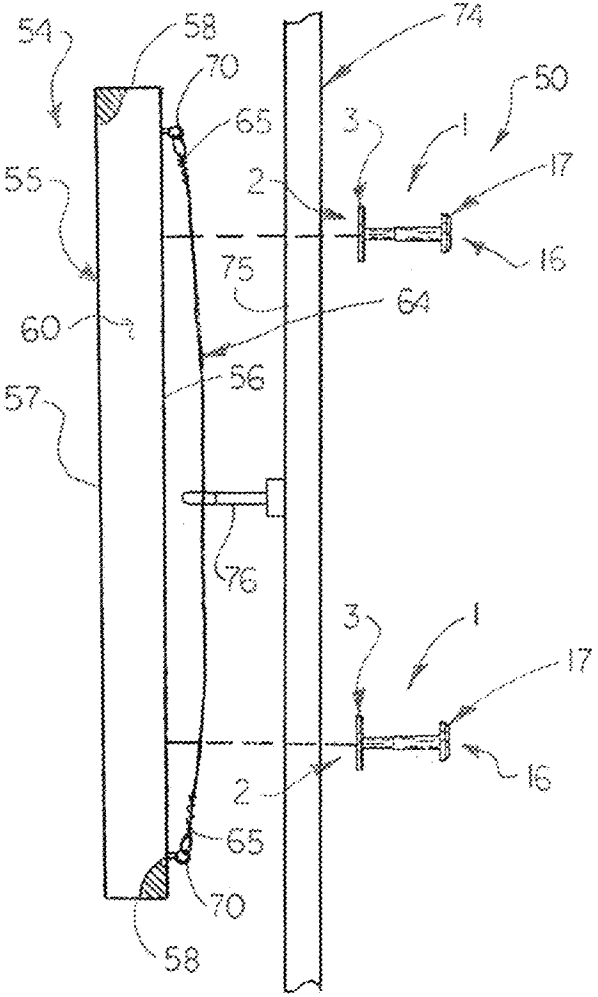
FIG. 12 is a top view of the flaccid object hanging wire engaging the object hanging hook after removal of the object hanging aid devices from between the object frame and the object hanging wire and before releasing and suspending the object from the object hanging hook.
Figure 11:
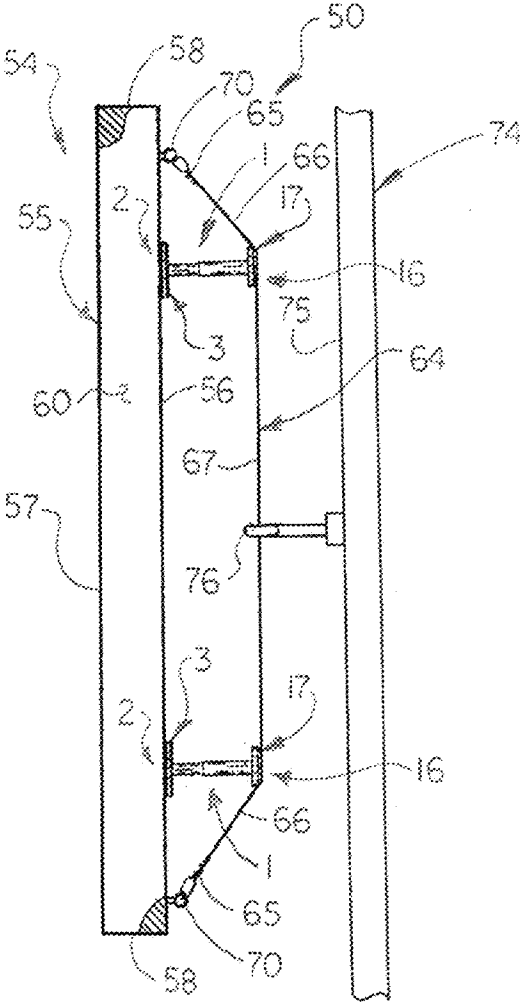
FIG. 11 is a top view of the illustrative object hanging aid system with the object hanging aid devices placed between the object frame and the extended object hanging wire illustrated in FIG. 10, more particularly illustrating typical subsequent engagement of the object hanging wire with an object hanging hook on the wall surface of the wall.

As illustrated in FIG. 11, the spanning wire segment 67 of the object hanging wire 64 may next be placed into engagement with the object hanging hook 76 on the wall surface 75 of the wall 74. Accordingly, the object 54 may initially be lifted or raised and the spanning wire segment 67 of the object hanging wire 64 positioned above the object hanging hook 76. The object 54 may then be lowered until the spanning wire segment 67 catches on or engages the object hanging hook 76. As illustrated in FIG. 12, the object hanging aid devices 1 may then be removed from between the object frame 55 and the object hanging wire 64 typically by disengagement of the object hanging surface 4 of the base plate 3 from the rear frame surface 56 of the object frame 55 and removal of the object hanging wire 64 from the wire groove 22 in the outer cap head surface 19 of the cap head 17. The object 54 may then be released such that the weight of the object 54 is applied to the object hanging wire 64 and the object hanging wire 64 assumes a hanging wire configuration, as illustrated in FIG. 13, in which the object hanging wire 64 suspends the object 54 from the wall 74.

Figure 15:
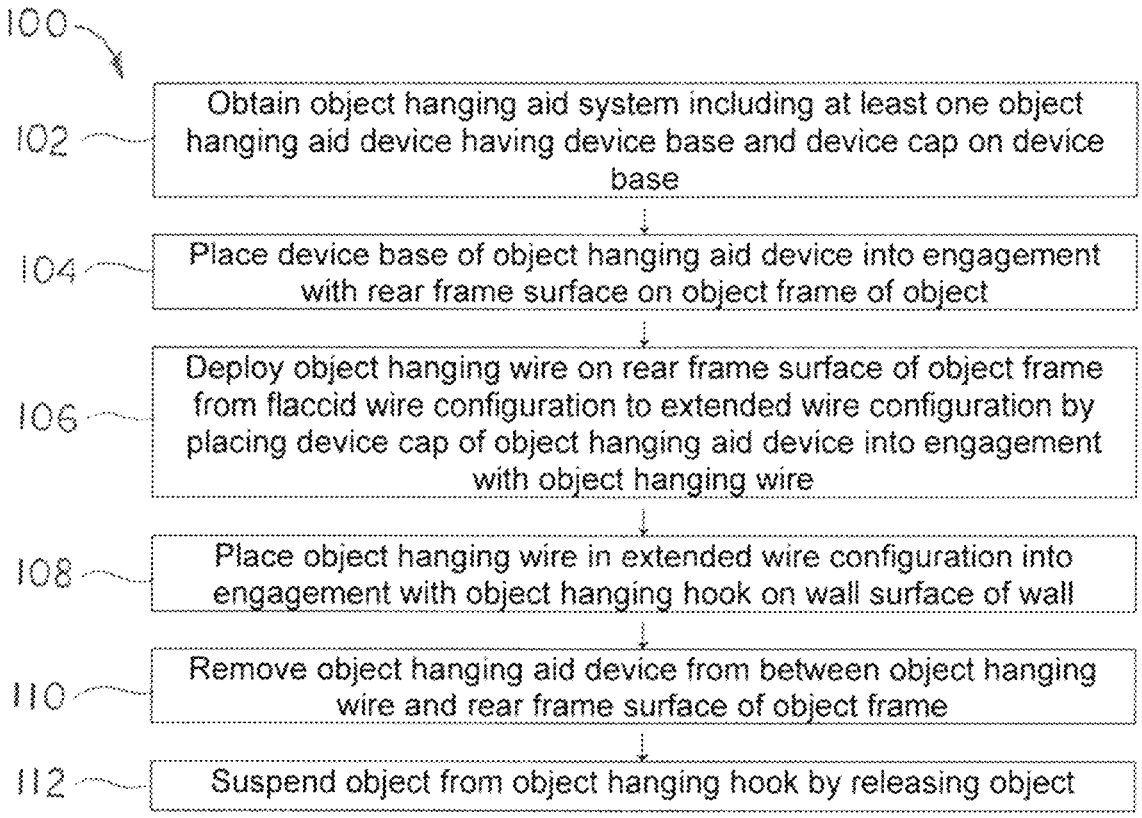
FIG. 15 is a flow diagram of an illustrative embodiment of the object hanging aid methods.

Referring next to FIG. 15 of the drawings, an illustrative embodiment of the object hanging aid methods is generally indicated by reference number 100. At Step 102, an object hanging aid system may be obtained. The object hanging aid system may include at least one object hanging aid device. The object hanging aid device may include a device base and a device cap on the device base.

At Step 104, the device base of the object hanging device may be placed into engagement with a rear frame surface on an object frame of an object.

At Step 106, an object hanging wire on the rear frame surface of the object frame may be deployed from a flaccid wire configuration to an extended wire configuration by placing the device cap of the object hanging aid device into engagement with the object hanging wire.

At Step 108, the object hanging wire in the extended wire configuration may be placed into engagement with an object hanging hook on a wall surface of a wall.

At Step 110, the object hanging aid device may be removed from between the object hanging wire and the rear frame surface of the object frame.

At Step 112, the object may be suspended from the object hanging hook by releasing the object.

It will be appreciated by those skilled in the art that the object hanging aid systems, devices and methods of the present disclosure may provide users with the ability to easily hang large picture frames, mirrors and other objects. The object hanging aid systems may be placed between the object hanging wire and the rear frame surface of the object frame without the need for modification of the object frame. The object hanging aid systems, devices and methods of the present disclosure may enable users to independently mount larger object frames on walls without the need for assistance from other persons and may maintain optimal security of the object frame to prevent inadvertent droppage of the object from the wall and damage to the object.

While certain illustrative embodiments of the disclosure have been described above, it will be recognized and understood that various modifications can be made to the embodiments and the appended claims are intended to cover all such modifications which may fall within the spirit and scope of the disclosure.

I claim:

1. An object hanging aid system suitable for assisting a user in hanging an object having an object frame and an object hanging wire on a wall surface, the object banging aid system comprising:

at least one object hanging aid device configured for placement between the object frame and the object hanging wire of the object, the at least one object hanging aid device comprising:

a device base configured to engage the object frame; and a device cap on the device base, wherein the device can is extendable and retractable with respect to the device base, the device cap configured to engage the object hanging wire.

2. The object hanging aid system of claim 1 wherein the at least one object hanging aid device comprises a pair of spaced-apart object hanging aid devices.

3. The object hanging aid system of claim 1 further comprising at least one device spring between the device base and the device cap.

4. The object hanging aid system of claim 3 wherein the device cap comprises a cap interior and the at least one device spring is disposed in the cap interior.

5. The object hanging aid system of claim 4 wherein the device base comprises at least one base stem slidably disposed in the cap interior of the device cap.

6. An object hanging aid system suitable for assisting a user in having an object having an object frame and an object hanging wire on a wall surface, the object hanging aid system comprising:

at least one object hanging aid device configured for placement between the object frame and the object hanging wire of the object, the at least one object hanging aid device comprising:

a device base configured to engage the object frame, wherein the device base comprises a flat or planar object engaging surface configured to engage the object hanging wire; and a device cap on the device base, the device cap configured to engage the object hanging wire.

7. An object hanging aid system suitable for assisting a user in hanging an object having an object frame and an object hanging wire on a wall surface, the object hanging aid system comprising:

at least one object hanging aid device configured for placement between the object frame and the object hanging wire of the object, the at least one object hanging aid device comprising:

a device base configured to engage the object frame; and a device cap on the device base, the device cap configured to engage the object hanging wire, wherein the device cap comprises a wire groove sized and configured to receive the object hanging wire.

8. An object hanging aid system suitable for assisting a user in hanging an object having an object frame and an object hanging wire on a wall surface, the object hanging aid system comprising:

at least one object hanging aid device configured for placement between the object frame and the object hanging wire of the object to deploy the object hanging wire from a flaccid wire configuration to an extended wire configuration, the at least one object hanging aid device comprising:

a device base comprising:

a base plate configured to engage the object frame; and a base stem extending from the base plate; and a device cap extendable and retractable with respect to the device base, the device cap comprising:

a cap head configured to engage the object hanging wire;

a cap housing extending from the cap head; and a cap interior in the cap housing, the cap interior sized and configured to slidably receive the base stem of the device base.

9. The object hanging aid system of claim 8 wherein the at least one object hanging aid device comprises a pair of spaced-apart object hanging aid devices.

10. The object hanging aid system of claim 8 further comprising at least one device spring in the cap interior between the base stem of the device base and the cap head of the device cap.

11. The object hanging aid system of claim 8 wherein the base plate of the device base comprises a flat or planar object engaging surface configured to engage the object frame.

12. The object hanging aid system of claim 11 wherein the base plate of the device base comprises a cap mount surface parallel and spaced-apart to the object engaging surface and a side base plate surface extending from the object engaging surface to the cap mount surface.

13. The object hanging aid system of claim 8 wherein the cap head of the device cap comprises a wire groove sized and configured to receive the object hanging wire.

14. The object hanging aid system of claim 13 wherein the cap head of the device cap comprises an inner cap head surface on the cap housing, an outer cap head surface parallel and spaced-apart to the inner cap head surface and a side cap head surface extending from the inner cap head surface to the outer cap head surface, and the wire groove extends into the outer cap head surface.

15. The object hanging aid system of claim 12 further comprising a beveled cap head surface extending from the outer cap head surface to the side cap head surface of the cap head.

16. An object hanging aid system suitable for assisting a user in hanging an object having an object frame and an object hanging wire on a wall surface, the object hanging aid system comprising:

a pair of spaced-apart object hanging aid devices configured for placement between the object frame and the object hanging wire of the object, each of the pair of spaced-apart object hanging aid devices comprising:

a device base comprising:

a base plate comprising:

a flat or planar object engaging surface configured to engage the object frame;

a cap mount surface parallel and spaced-apart to the object engaging surface; and a side base plate surface extending from the object engaging surface to the cap mount surface; and a base stem extending from the cap mount surface of the base plate; and a device cap extendable and retractable with respect to the device base, the device cap comprising:

a cap head comprising:

an inner cap head surface;

an outer cap head surface parallel and spaced-apart to the inner cap head surface, the outer cap head surface configured to engage the object hanging wire; and a side cap head surface extending from the inner cap head surface to the outer cap head surface;

a cap housing having a cap housing wall extending from the inner cap head surface of the cap head; and a cap interior formed by the cap housing wall of the cap housing, the cap interior sized and configured to slidably receive the base stem of the device base.

17. The object hanging aid system of claim 16 further comprising a wire groove in the outer cap head surface of the cap head of the device cap, the wire groove sized and configured to receive the object hanging wire.

18. The object hanging aid system of claim 17 further comprising a beveled cap head surface extending from the outer cap head surface to the side cap head surface of the cap head.

19. The object hanging aid system of claim 16 further comprising at least one device spring disposed in the cap interior of the cap housing between the base stem of the device base and the cap head of the device cap.

* * * * *